US009212020B2

(12) United States Patent
Nakada et al.

(10) Patent No.: US 9,212,020 B2
(45) Date of Patent: Dec. 15, 2015

(54) SHEET PROCESSING APPARATUS AND IMAGE FORMING SYSTEM

(71) Applicants: Kyosuke Nakada, Ebina (JP); Tomohiro Furuhashi, Ebina (JP); Shuuya Nagasako, Ebina (JP); Michitaka Suzuki, Ebina (JP); Akira Kunieda, Ebina (JP); Takahiro Watanabe, Ebina (JP); Yuji Suzuki, Ebina (JP); Tomomichi Hoshino, Ebina (JP)

(72) Inventors: Kyosuke Nakada, Ebina (JP); Tomohiro Furuhashi, Ebina (JP); Shuuya Nagasako, Ebina (JP); Michitaka Suzuki, Ebina (JP); Akira Kunieda, Ebina (JP); Takahiro Watanabe, Ebina (JP); Yuji Suzuki, Ebina (JP); Tomomichi Hoshino, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/274,493

(22) Filed: May 9, 2014

(65) Prior Publication Data

US 2015/0031520 A1 Jan. 29, 2015

(30) Foreign Application Priority Data

Jul. 25, 2013 (JP) ..... 2013-154811

(51) Int. Cl.

| | |
|---|---|
| ***B65H 45/20*** | (2006.01) |
| ***B65H 9/00*** | (2006.01) |
| ***B65H 45/14*** | (2006.01) |
| ***B31F 1/10*** | (2006.01) |
| ***B31F 1/00*** | (2006.01) |

(52) U.S. Cl.

CPC ..... *B65H 45/20* (2013.01); *B31F 1/0025* (2013.01); *B31F 1/10* (2013.01); *B65H 9/00* (2013.01); *B65H 45/14* (2013.01); *B65H 45/147* (2013.01); *B65H 2801/27* (2013.01)

(58) Field of Classification Search

CPC ..... B31F 1/10; B31F 1/0025; B65H 45/20; B65H 45/147

USPC ..... 270/32, 39.01; 493/416, 419, 421, 434, 493/435, 440, 442

See application file for complete search history.

(56) References Cited

U.S. PATENT DOCUMENTS

| | | | | |
|---|---|---|---|---|
| 5,049,227 | A * | 9/1991 | Long | B31B 11/00 156/362 |
| 5,391,138 | A * | 2/1995 | Abramson | B65H 45/145 271/186 |
| 5,769,774 | A * | 6/1998 | Beck et al. | 493/421 |
| 6,024,682 | A * | 2/2000 | Mandel et al. | 493/23 |
| 6,589,000 | B1 * | 7/2003 | Boss | 412/9 |
| 6,719,680 | B2 * | 4/2004 | Hosoya et al. | 493/324 |
| 7,052,005 | B2 * | 5/2006 | Yamakawa et al. | 270/37 |
| 7,794,381 | B2 * | 9/2010 | Yamamoto et al. | 493/421 |
| 7,946,565 | B2 * | 5/2011 | Kubota | B42C 9/0037 270/21.1 |

(Continued)

*Primary Examiner* — Leslie A Nicholson, III

(74) *Attorney, Agent, or Firm* — Oblon, McClelland, Maier & Neustadt, L.L.P.

(57) ABSTRACT

A sheet processing apparatus including a first conveying member that conveys a sheet, a second conveying member that receives the sheet conveyed by the first conveying member and further conveys the sheet to a subsequent stage, a third conveying member that receives the sheet conveyed by the first conveying member and further folds the sheet, a guiding member that guides the sheet when the sheet is folded by the third conveying member, and is arranged between the second conveying member and the third conveying member. The sheet is guided along the guiding member when a bending part of the sheet is conveyed to the third conveying member by rotating the second conveying member in a reverse direction while the sheet is held by the first conveying member and the second conveying member.

7 Claims, 12 Drawing Sheets

(56) References Cited

U.S. PATENT DOCUMENTS 8,256,757 B2 * 9/2012 Imazu ..... B65H 45/148 270/32
8,585,032 B2 * 11/2013 Sano et al. ..... 270/20.1
2007/0290427 A1 * 12/2007 Horii et al. ..... 270/32
2009/0062099 A1 * 3/2009 Yamamoto ..... B65H 45/144 493/442
2012/0004085 A1 * 1/2012 Smith et al. ..... 493/421

* cited by examiner

SHEET PROCESSING APPARATUS AND IMAGE FORMING SYSTEM

CROSS-REFERENCE TO RELATED APPLICATIONS

The present patent application is based on and claims priority pursuant to 35 U.S.C. §119 from Japanese Patent Application No. 2013-154811, filed on Jul. 25, 2013, in the Japan Patent Office, which is incorporated by reference herein in its entirety.

TECHNICAL FIELD

The present invention relates to a sheet processing apparatus and an image forming system. In particular, the present invention relates to a sheet processing apparatus that folds a sheet recording medium (hereinafter, referred to as "a sheet"), such as a sheet of paper, a transfer sheet, a printing sheet, or an overhead projector (OHP) sheet, conveyed thereto, an image forming system including the sheet processing apparatus and an image forming apparatus, such as a copier, a printer, a facsimile machine, or a digital multifunction peripheral, and a sheet folding method performed by the sheet processing apparatus.

BACKGROUND ART

Conventionally, sheet processing apparatuses include, for a folding process, a stopper and a dedicated path branching from a conveying path used to convey a sheet from an upstream device to a downstream device, and perform the folding process based on a so-called end-abutting in which a leading end of a sheet is caused to abut. That is, in the folding process, the sheet is caused to abut against the stopper in the dedicated path to adjust a folding position and form the deflected portion, and the deflected portion is nipped by a folding unit to fold the sheet.

JP2000-159433 discloses a folding structure with a reversible conveying roller pair without the stopper as shown in FIGS. 18A-18D. In FIG. 18A and FIG. 18B, a sheet is conveyed to a path with a conveying roller pair R1 and a reversible conveying roller pair R2. Next, in FIG. 18C, the sheet is bent by rotating the reversible conveying roller pair R2 in a reverse direction. Finally, in FIG. 18D, the bending part of the sheet is conveyed to the nip between a conveying roller R1*a* and a folding roller R3, and the sheet is folded.

However as shown in FIGS. 18C and 18D, the sheet with a first bending part F1 and a second bending part F2 is probably folded, when there is a space W2*v* between the conveying roller pair R1 and the folding roller R3. As such, a bending direction of the sheet is various and the sheet may not be folded at a desired position.

SUMMARY

In light of the problems and circumstances described above, a main object of the present application is to provide a sheet processing apparatus, an image forming system, and a sheet folding method that improves the accuracy of the folding position.

According to an embodiment of the present application, a sheet processing apparatus includes: a first conveying member that conveys a sheet, a second conveying member that receives the sheet conveyed by the first conveying member and further conveys the sheet to a subsequent stage, a third conveying member that receives the sheet conveyed by the first conveying member and further folds the sheet, a guiding member that guides the sheet when the sheet is folded by the third conveying member, and is arranged between the second conveying member and the third conveying member. The sheet is guided along the guiding member when a bending part of the sheet is conveyed to the third conveying member by rotating the second conveying member in a reverse direction while the sheet is held by the first conveying member and the second conveying member.

DETAILED DESCRIPTION

Figure 1:
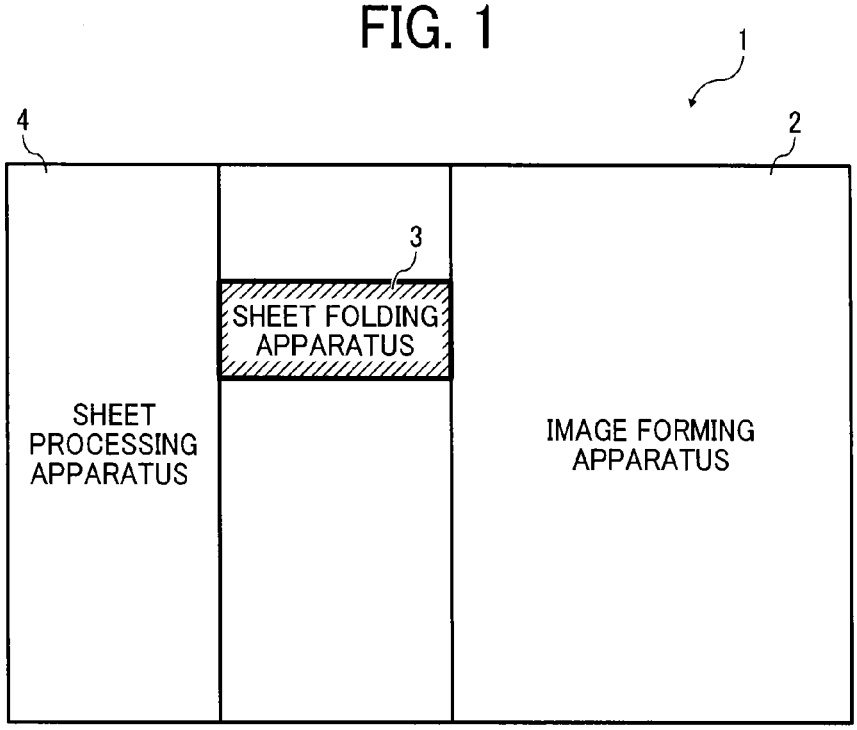
FIG. 1 is a diagram illustrating an overall configuration of an image forming system according to an embodiment of the present invention.

FIG. 1 is a diagram illustrating an overall configuration of an image forming system according to an embodiment of the present invention. In FIG. 1, an image forming system 1 according to an embodiment mainly includes an image forming apparatus 2, a folding apparatus 3, and a post-processing apparatus 4. The folding apparatus 3 is disposed between the preceding image forming apparatus 2 and the subsequent post-processing apparatus 4. The folding apparatus 3 receives a sheet on which an image is formed by the image forming apparatus 2, performs a predetermined folding process on the sheet, and conveys the sheet to the post-processing apparatus 4. The post-processing apparatus 4 performs post-processing, such as aligning, stitching, or bookbinding on a sheet subjected to the folding process or a sheet that is not subjected to the folding process.

Figure 2:
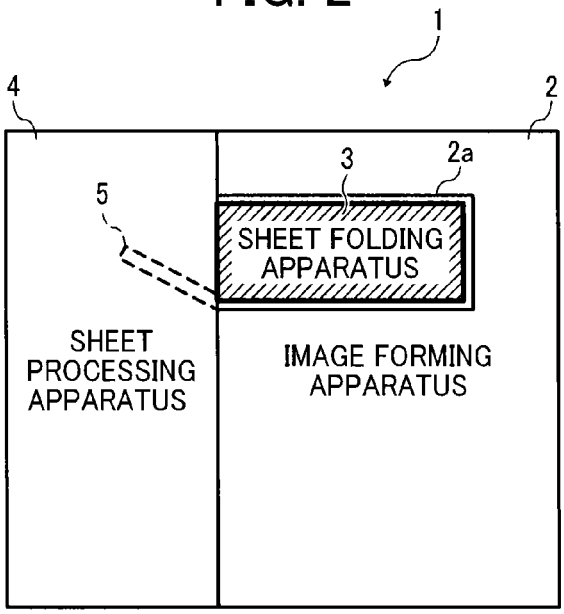
FIG. 2 is a diagram illustrating an overall configuration of an image forming system according to another embodiment of the present invention.

FIG. 2 is a diagram illustrating an overall configuration of an image forming system according to another embodiment of the present invention. In FIG. 2, the folding apparatus 3 is a so-called body inside installation type and is provided in a sheet discharge unit inside the image forming apparatus 2. In the image forming system 1 illustrated in FIG. 2, the folding apparatus 3 is disposed in a body inside sheet discharge unit 2*a* of the image forming apparatus 2, and only a discharge tray 5 protrudes from the footprint of the image forming apparatus 2. Therefore, the size of the system is greatly reduced compared with the system illustrated in FIG. 1.

Figure 3:
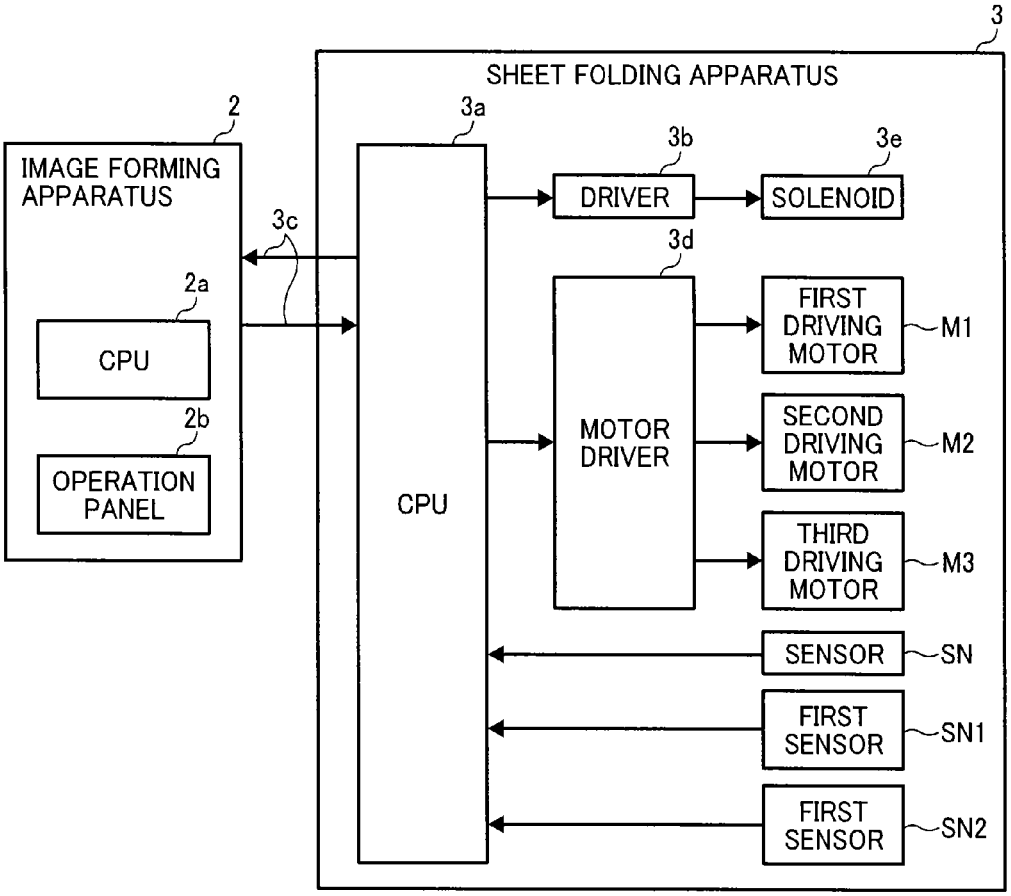
FIG. 3 is a block diagram illustrating a control configuration of the image forming system according to an embodiment of the present invention.

In FIG. 3, the folding apparatus 3 includes a control circuit provided with a microcomputer including a CPU 3*a*. A signal from a CPU 2*a* of the image forming apparatus 2, each switch of an operation panel 2*b*, or the like is input to the CPU 3*a* via a communication interface 3*c*. The CPU 3*a* performs predetermined control based on the signals input from the image forming apparatus 2. The CPU 3*a* also controls driving of a solenoid 3*e*, a first driving motor M1, a second driving motor M2 and a third driving motor M3 via a driver 3*b* and a motor driver 3*d*. Furthermore, the CPU 3*a* acquires a sheet detecting information from a sensor SN, a first sensor SN1 and a second sensor SN2.

Embodiment 1

Figure 4:
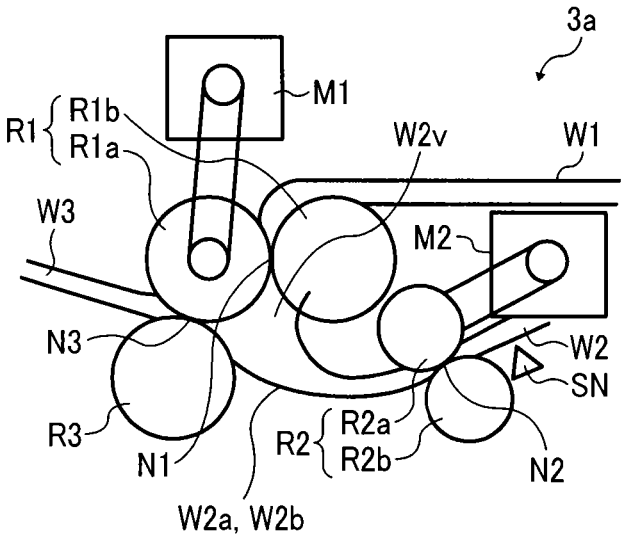
FIG. 4 is a diagram showing a schematic configuration of a sheet folding mechanism according to embodiment 1.

In FIG. 4, a sheet folding apparatus 3 includes a first conveying path W1, a second conveying path W2, and a third conveying path W3. The first conveying path W1 receives a sheet from the image forming apparatus 2 and conveys the sheet to a first conveying member R1. The second conveying path W2 conveys the sheet from the first conveying member R1 to the second conveying member R2, and conveys the sheet to a third conveying member R3 in a reverse direction. The third conveying path W3 conveys the sheet from the third conveying member R3 to a sheet processing apparatus 4 or a discharge tray 5.

The first conveying member R1 is arranged downstream of the first conveying member R1, and includes a driving roller R1*a* and a driven roller R1*b*, forms a first nip N1 between the driving roller R1*a* and the driven roller R1*b*. The driving roller R1*a* is driven by a first driving motor M1 through a timing belt. The driven roller R1*b* is driven by rotation of the driving roller R1*a*.

The second conveying member R2 is arranged at a position so that a distance on the second conveying path W2 between the second conveying member R2 and the first nip N1 is shorter than the smallest size of a sheet. The second conveying member R2 includes a driving roller R2*a* and a driven roller R2*b*, forms a first nip N2 between the driving roller R2*a* and the driven roller R2*b*. The driving roller R2*a* is driven by a second driving motor M2 through a timing belt. The driven roller R2*b* is driven by rotation of the driving roller R2*a*. The second driving motor M2 can rotate in a forward and a backward direction.

The third conveying member R3 is arranged at a juncture of the second conveying path W2 and the third conveying path W3. The third conveying member R3 contacts the driving roller R1*a* of the first conveying member R1 at a third nip N3, and is driven by rotating of the driving roller R1*a*. In other words, the first driving motor M1 drives the driving roller R1*a*, the driven roller R1*b* and the third conveying member R3. The third conveying member R3 functions as a folding part to fold a sheet.

In FIG. 4, the second conveying path W2 forms a space W2*v* downstream of the first nip N1. A guiding plate W2*a* forms a curved part W2*b* as an opposite surface opposing the first nip N1 and is concave. The second conveying path W2 ranges with downstream of the curved part W2*b*. The space W2*v* allows a sheet to be bent.

Figure 5A:
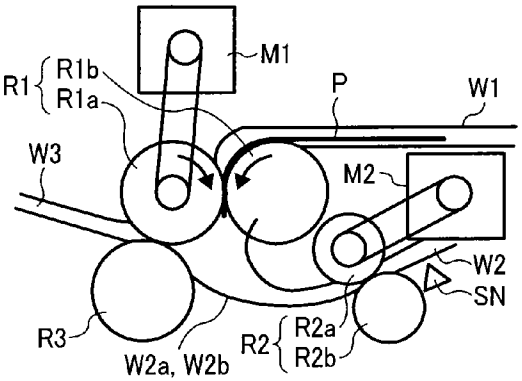
FIGS. 5A-5D are a diagram showing a operation of a sheet folding mechanism according to embodiment 1.

FIGS. 5A-5D illustrate the use of the apparatus of FIG. 4 during a folding process. In FIG. 5A, a sheet P is conveyed to the first conveying member R1 along the first conveying path W1.

Figure 5B:
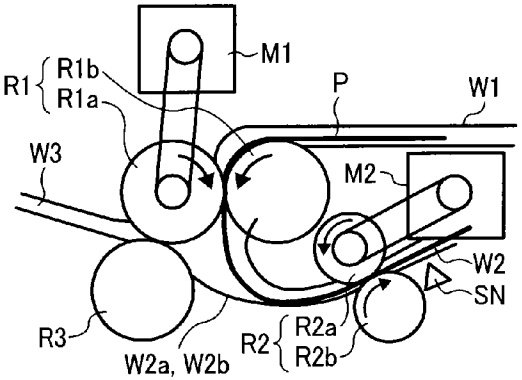

In FIG. 5B, the sheet P is conveyed to the second conveying member R2 through the space W2*v* and is further conveyed by the second conveying member R2. The sheet is conveyed a determined distance after the tip of the sheet P is detected by a sensor SN.

Figure 5C:
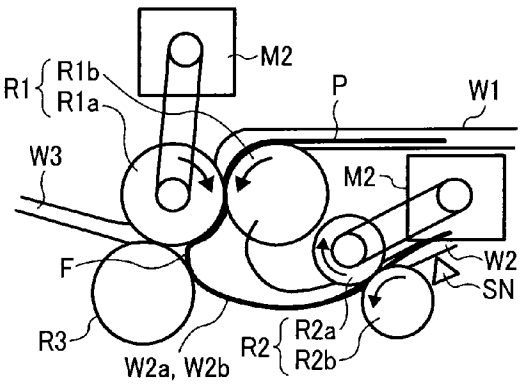

In FIG. 5C, the second conveying member R2 rotates while holding the sheet P in a reverse direction to the sheet conveying direction while the first conveying member R1 continues to rotate while holding the sheet P. As such, the sheet P moves to the guiding plate W2*a* and forms a bending part F along the guiding plate W2*a*.

Figure 5D:
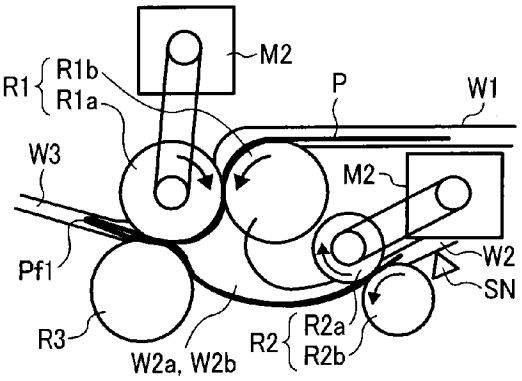

In FIG. 5D, the bending part F of the sheet P inserts into the third nip N3 between the conveying member R3 and the driving roller R1*a*, and a folding part Pf1 is formed. In addition, the folding part Pf1 of the sheet P is conveyed downstream of the third conveying path W3 by the conveying member R3 and the driving roller R1*a*.

As such, the sheet P is deformed along the curved part W2*b* by a stiffness of the sheet P as the sheet P contacts an inside of the guiding plate W2*a* when the bending part F of the sheet P is conveyed to the third nip N3 by the first conveying member R1 and the second conveying member R2. Therefore the structure prevents forming plural bending types of the sheet P in the space W2*v* as shown in FIG. 18. An accuracy of a folding position can be improved.

Figure 6:
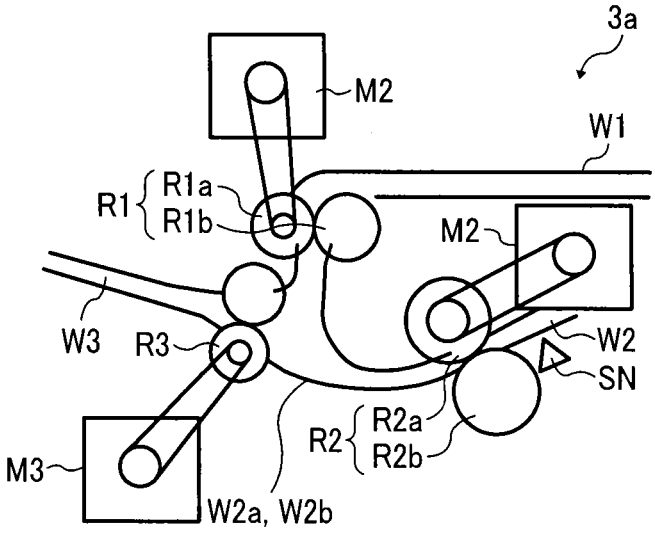
FIG. 6 is a diagram showing a schematic configuration of a sheet folding mechanism according to modification 1 of embodiment 1.

FIG. 6 is a diagram showing a schematic configuration of a sheet folding mechanism according to modification 1 of embodiment 1. The conveying member R3 includes a driving roller R3*a* and a driven roller R3*b*, and is driven by a third motor M3 independently. On the other hand, the conveying member R3 may be driven by the first motor M1.

Figure 7:
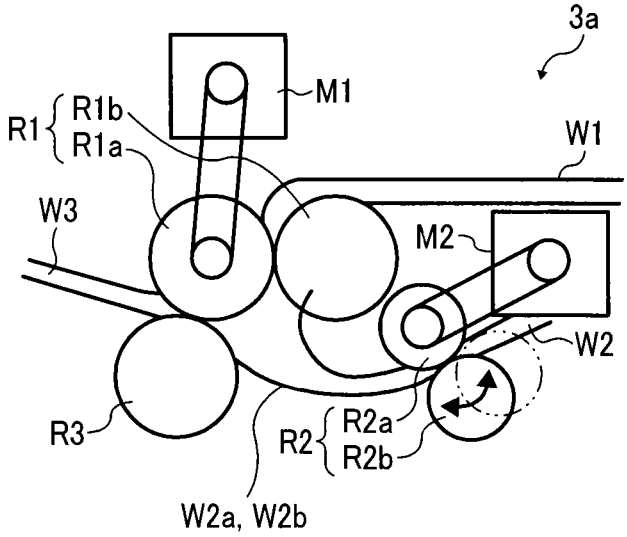
FIG. 7 is a diagram showing a schematic configuration of a sheet folding mechanism according to modification 2 of embodiment 1.

FIG. 7 is a diagram showing a schematic configuration of a sheet folding mechanism according to modification 2 of embodiment 1. In the modification, the position of the second nip N2 in the second conveying member R2 can be altered. In other words, the driven roller R2*b* can move downstream in a conveying direction. As such, a tangent of the second nip N2 is made oblique, as shown in FIG. 7, when the driven roller R2*b* moves downstream. As such, the sheet P moves to the guiding plate W2*a* and forms the bending part F along the guiding plate W2*a* when the sheet P is conveyed to the third conveying member R3 by rotating of the second conveying member R2 in the reverse direction. Therefore, the structure prevents forming plural bending types of the sheet P in the space W2*v* as shown in FIG. 18, and an accuracy of a folding position can be improved.

Figure 8:
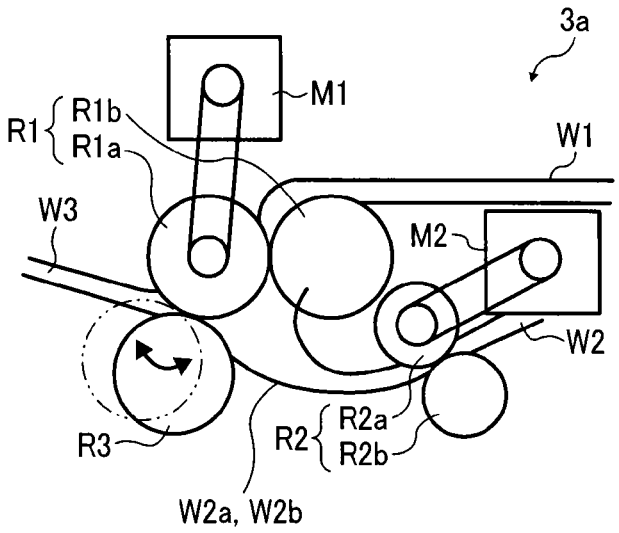
FIG. 8 is a diagram showing a schematic configuration of a sheet folding mechanism according to modification 3 of embodiment 1.

FIG. 8 is a diagram showing a schematic configuration of a sheet folding mechanism according to modification 3 of embodiment 1. In this modification, the position of the third nip N3 in the third conveying member R3 can be altered. In other words, the third conveying member R3 can move downstream in a conveying direction. As such, a tangent of the second nip N2 is made oblique, as shown in FIG. 8, when the third conveying member R3 moves downstream. As such, the sheet P moves to the guiding plate W2*a* and forms the bending part F along the guiding plate W2*a* when the sheet P is conveyed to the third conveying member R3 by rotation of the second conveying member R2 in the reverse direction. Therefore, the structure prevents forming plural bending types of the sheet P in the space W2*v* as shown in FIG. 18, and an accuracy of a folding position can be improved.

On the other hand, each position of the second nip N2 and the third nip N3 in modification 2 and modification 3 is arranged according to sheet information such as a sheet type, a sheet size, and a sheet thickness. The arranged position is set by CPU 3*a* referring to, for example, a table recorded in a memory. The arranging mechanism includes guide members for guiding the moving direction of the second conveying member R2 or the third conveying member R3, a motor for moving the second conveying member R2 or the third conveying member R3, etc.

Embodiment 2

Figure 9:
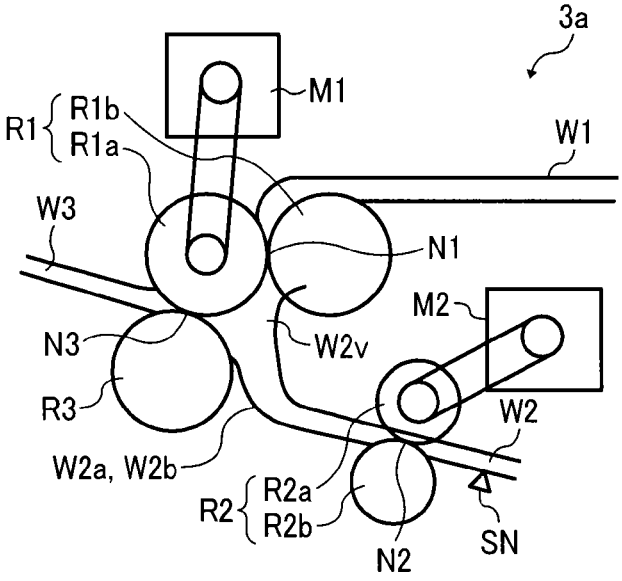
FIG. 9 is a diagram showing a schematic configuration of a sheet folding mechanism according to embodiment 2.

In FIG. 9, the second conveying path W2 and the third conveying path W3 are arranged as the tangent of the second nip N2 and the tangent of the third nip N3, and are parallel to each other. The curved part W2*b* in the guiding plate W2*a* is formed between the second conveying member R2 and the third conveying member R3. The curved part W2*b* is formed as the facing side of the first nip N1, and is concave.

Figure 10A:
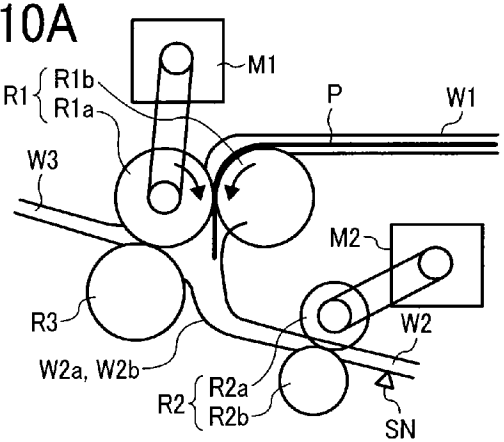
FIGS. 10A-10D are a diagram showing an operation of a sheet folding mechanism according to embodiment 2.

FIGS. 10A-10D illustrate the operation of the second embodiment. In FIG. 10A, the sheet P is conveyed to the first conveying member R1 along the first conveying path W1.

Figure 10B:
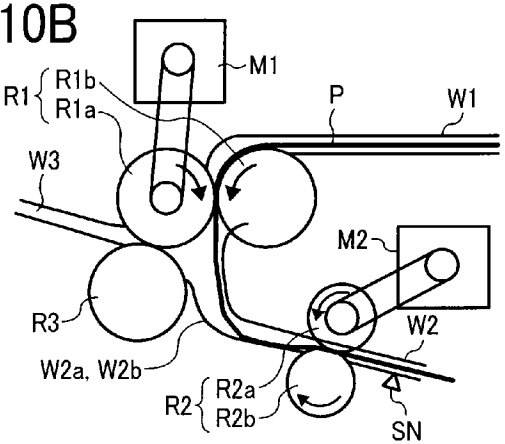

In FIG. 10B, the sheet P is conveyed to the second conveying member R2 and is further conveyed by the second conveying member R2. Further, the sheet is conveyed a determined distance after the tip of the sheet P is detected by the sensor SN.

Figure 10C:
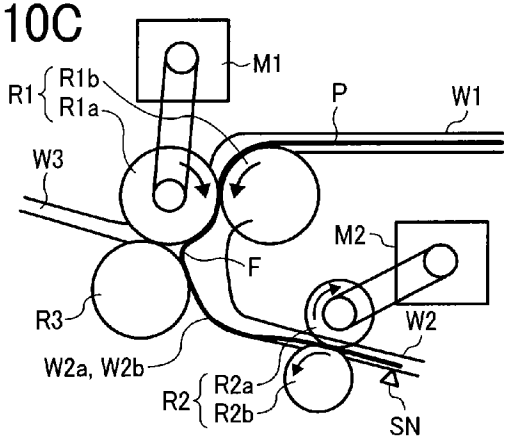

In FIG. 10C, the second conveying member R2 rotates while holding the sheet P in a reverse direction to the sheet conveying direction while the first conveying member R1 continues to rotate while holding the sheet P. As such, the sheet P moves to the guiding plate W2*a* and forms a bending part F along the guiding plate W2*a*.

Figure 10D:
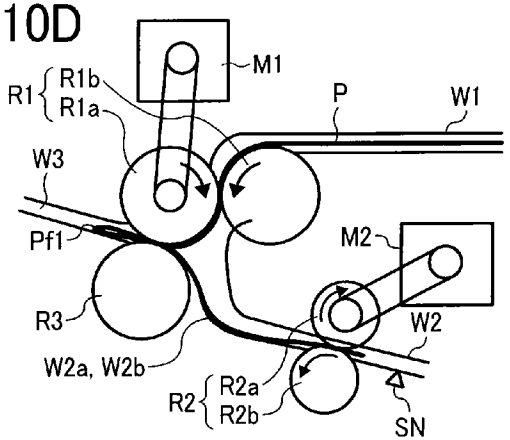

In FIG. 10D, the bending part F of the sheet P inserts into the third nip N3 between the conveying member R3 and the driving roller R1*a*, and a folding part Pf1 is formed. In addition, the folding part Pf1 of the sheet P is conveyed downstream of the third conveying path W3 by the conveying member R3 and the driving roller R1*a*.

As shown in FIGS. 10A-10D, a curvature of the curved part W2*b* in embodiment 2 is larger than that in embodiment 1. Therefore the structure prevents forming plural bending types of the sheet P in the space W2*v* as shown in FIG. 18.

Figure 11:
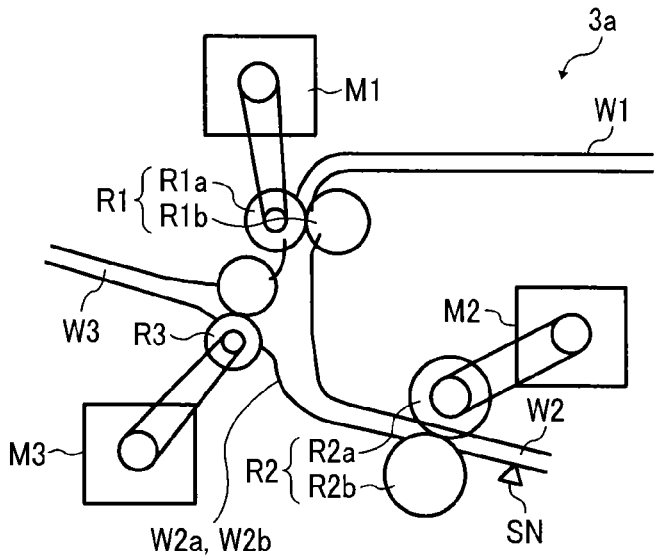
FIG. 11 is a diagram showing a schematic configuration of a sheet folding mechanism according to modification 1 of embodiment 2.

FIG. 11 is a diagram showing a schematic configuration of a sheet folding mechanism according to modification 1 of embodiment 2. The conveying member R3 includes a driving roller R3*a* and a driven roller R3*b*, and is driven by a third motor M3 independently, like modification 1 of embodiment 1.

Figure 12:
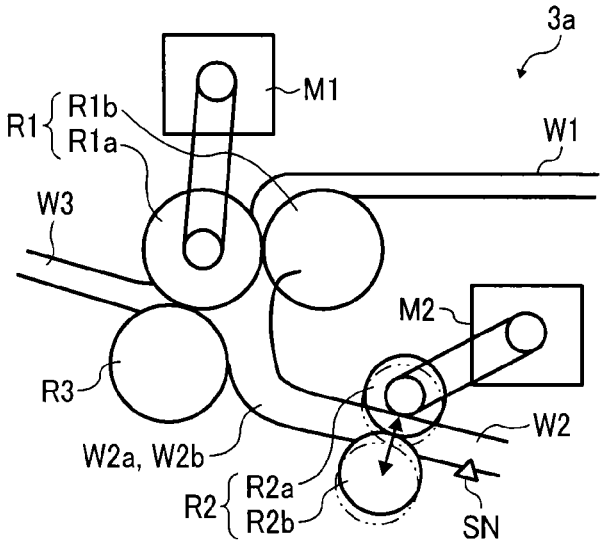
FIG. 12 is a diagram showing a schematic configuration of a sheet folding mechanism according to modification 2 of embodiment 2.

FIG. 12 is a diagram showing a schematic configuration of a sheet folding mechanism according to modification 2 of embodiment 2. In FIG. 12, a position of the second nip N2 in the second conveying member R2 can be moved. In other words, the driven roller R2*b* can be moved in a direction orthogonal to the conveying direction. The sheet P is conveyed along inside of the guiding member W2*a* when the driven roller R2*b* is moved to the guiding member W2*a* and the sheet P is conveyed by rotating of the second conveying member R2 in the reverse direction. As such, the sheet P can contact the curved part W2*b* of more upstream and the bending part F of the sheet P is formed. Therefore the structure prevents forming plural bending types of the sheet P in the space W2*v* as shown in FIG. 18.

Figure 13:
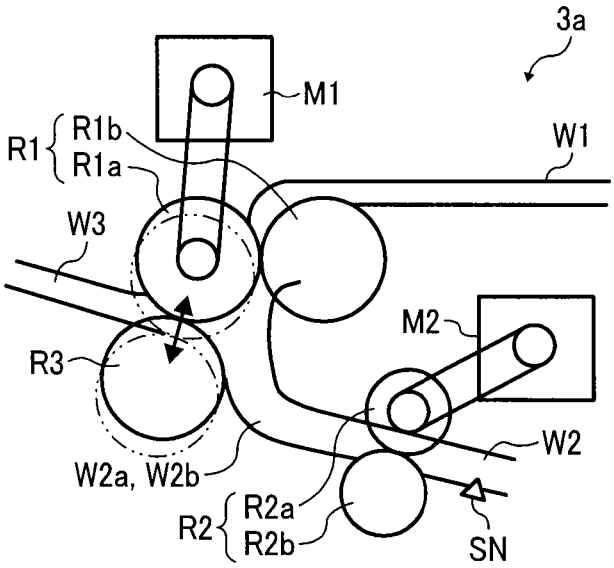
FIG. 13 is a diagram showing a schematic configuration of a sheet folding mechanism according to modification 3 of embodiment 2.

FIG. 13 is a diagram showing a schematic configuration of a sheet folding mechanism according to modification 3 of embodiment 2. In FIG. 13, a position of the third nip N3 in the third conveying member R3 can be moved. In other words, the third conveying member R3 can be moved in a direction orthogonal to the conveying direction. The bending part F of the sheet P is conveyed to the third conveying member R3 smoothly when the driven roller R2*b* is moved downward and the sheet P is conveyed by rotating of the second conveying member R2 in the reverse direction. As such, the structure prevents forming plural bending types of the sheet P in the space W2*v* as shown in FIG. 18.

Embodiment 3

Figure 14:
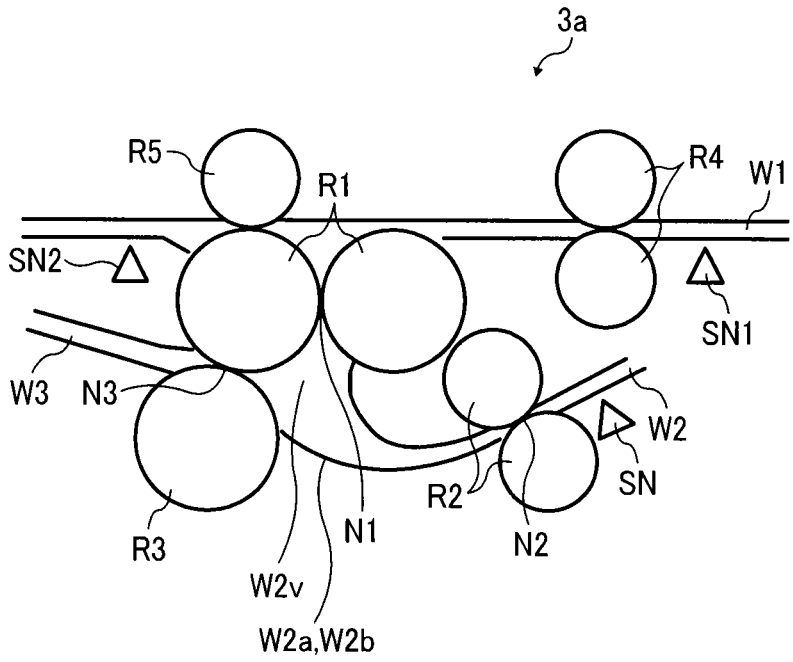
FIG. 14 is a diagram showing a operation of a sheet folding mechanism according to embodiment 3.

In FIG. 14, the sheet folding apparatus 3 according to embodiment 3 includes a fourth conveying member R4, a fifth conveying member R5, a first sensor SN1, and a second sensor SN2 in addition to the folding mechanism 3*a* according to embodiment 1. As such, the structure also enables a Z-folding, an outward three-folding and an inward three-folding. The fifth conveying member R5 contacts the driving roller R1*a* and is driven by the driving roller R1*a*.

The each timing that the fifth conveying member R5, the first conveying member R1, the second conveying member R2 and the third conveying member R3 rotate in a reverse direction to the conveying direction, the structure also enables a Z-folding, an outward three-folding and an inward three-folding.

Figure 15:
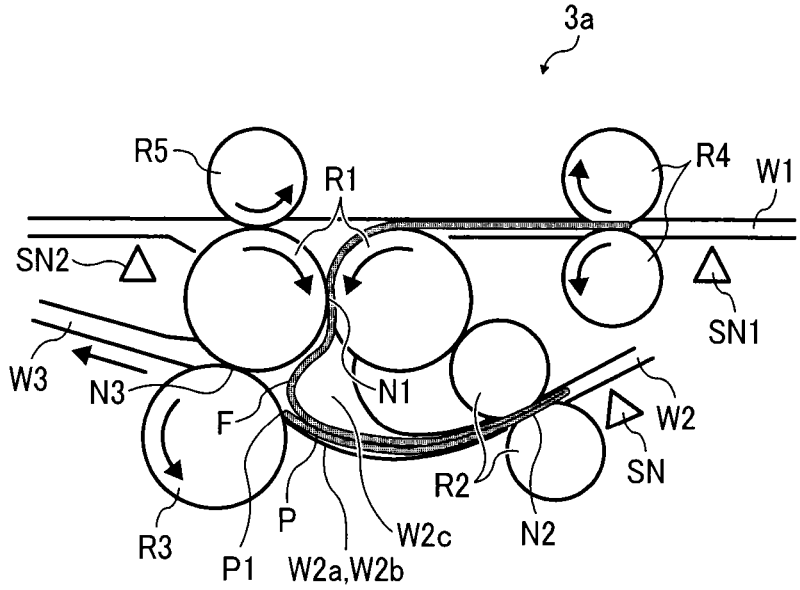
FIG. 15 is a diagram showing a Z-folding operation of a sheet folding mechanism according to embodiment 3.

FIG. 15 is a diagram showing a second folding operation of a Z-folding operation according to embodiment 3. The sheet P that a part of ¼ from the sheet P tip is folded by the first conveying member R1, is conveyed to the reverse direction by the second conveying member R2, and a bending part F of the sheet P is formed. The bending part F of the sheet P inserts in the third nip N3, and a second folding of the sheet P is formed.

Figure 16:
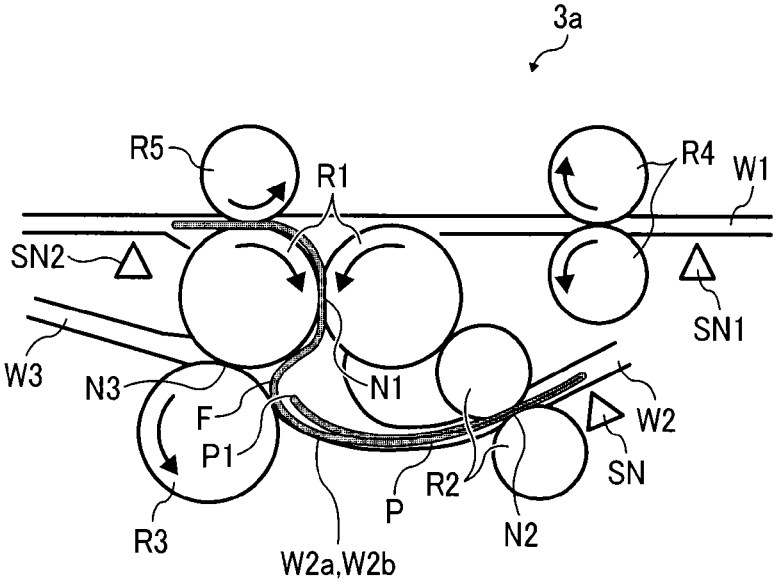
FIG. 16 is a diagram showing a inward three-folding operation of a sheet folding mechanism according to embodiment 3.

FIG. 16 is a diagram showing a second folding operation of an inward three-folding operation according to embodiment 3. The sheet P that a part of ⅓ from the sheet P tip is folded by the first conveying member R1, is conveyed to the reverse direction by the second conveying member R2, and a bending part F of the sheet P is formed. The bending part F of the sheet P inserts in the third nip N3, and a second folding of the sheet P is formed.

Figure 17:
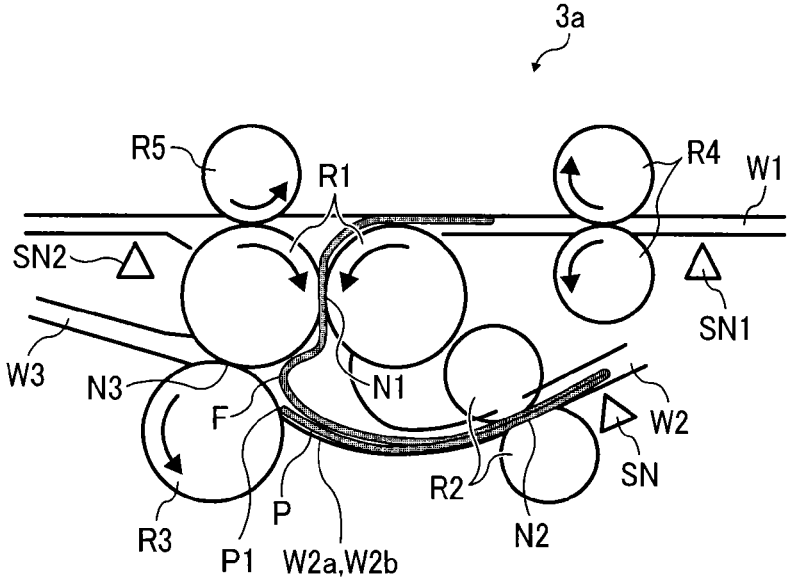
FIG. 17 is a diagram showing a outward three-folding operation of a sheet folding mechanism according to embodiment 3.
Figure 18A:
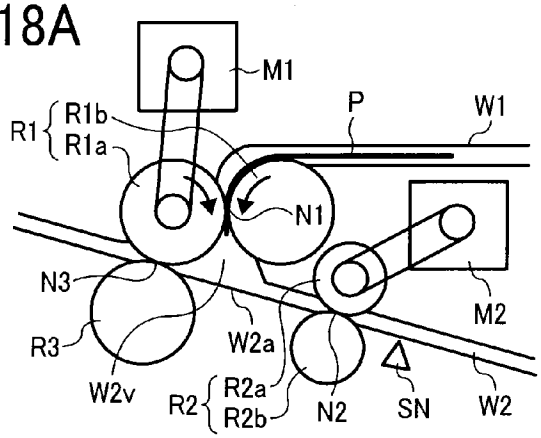
FIGS. 18A-18D are a diagram illustrating a generally well known operation to fold a sheet.
Figure 18B:
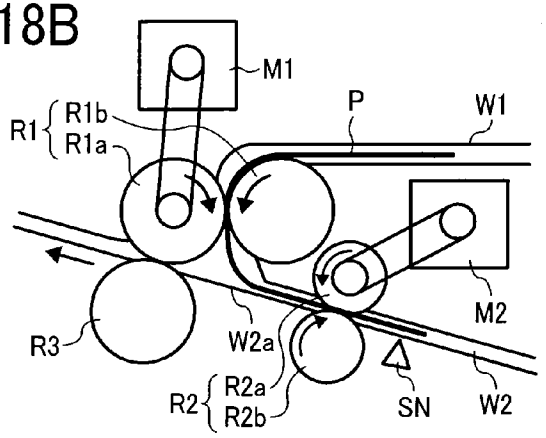
Figure 18C:
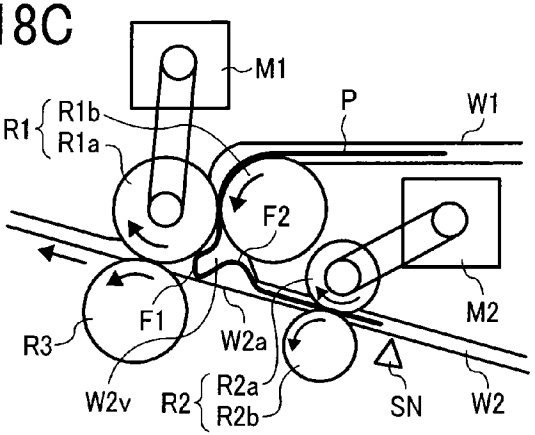
Figure 18D:
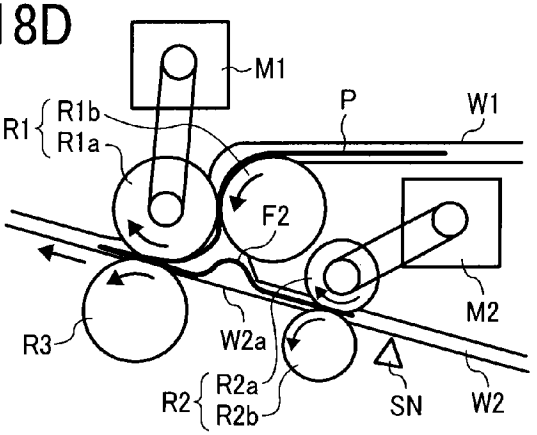

FIG. 17 is a diagram showing a second folding operation of an outward three-folding operation according to embodiment 3. The sheet P that a part of ⅓ from the sheet P tip is folded by the first conveying member R1, is conveyed to the reverse direction by the second conveying member R2, and a bending part F of the sheet P is formed. The bending part F of the sheet P inserts in the third nip N3, and a second folding of the sheet P is formed.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The invention claimed is:

1. A sheet processing apparatus, comprising:

a first conveying roller pair that conveys a sheet;

a second conveying roller pair that receives the sheet conveyed by the first conveying roller pair and further conveys the sheet to a subsequent stage;

a third conveying roller pair that receives the sheet conveyed by the first conveying roller pair and folds the sheet;

a guiding member that guides the sheet when the sheet is folded by the third conveying roller pair, and is arranged between the second conveying member and the third conveying roller pair; and a sensor configured to detect an end of the sheet and is disposed downstream of the second conveying roller pair but not between second conveying roller pair and third conveying roller pair, wherein the sheet is guided along the guiding member when a bending part of the sheet is conveyed to the third conveying roller pair by rotating the second conveying roller pair in a reverse direction while the sheet is held by the first conveying roller pair and the second conveying roller pair, and wherein the guiding member is stationary and has a concave shape.

2. A sheet processing apparatus as claimed in claim 1 wherein: the guiding member includes a curved part as an opposite surface opposing the first conveying roller pair is concave.

3. A sheet processing apparatus as claimed in claim 2, wherein: a bent part of the sheet is guided to a nip of the third conveying roller pair while the sheet contacts the opposite surface of the guiding member.

4. A sheet processing apparatus as claimed in claim 1, wherein:

a nip position of the second conveying roller pair is changed according to sheet information.

5. A sheet processing apparatus as claimed in claim 1, wherein: a nip position of the third conveying roller pair is changed according to sheet information.

6. A sheet processing apparatus as claimed in claim 4, wherein:

the sheet information includes one of the sheet species, the sheet thicknesses and the sheet sizes.

7. An image forming system, comprising:

an image forming unit that forms an image on a sheet;

a first conveying roller pair that conveys the sheet;

a second conveying roller pair that receives the sheet conveyed by the first conveying roller pair and further conveys the sheet to a subsequent stage;

a third conveying roller pair that receives the sheet conveyed by the first conveying roller pair and further folds the sheet;

a guiding member that guides the sheet when the sheet is folded by the third conveying roller pair, and is arranged between the second conveying member and the third conveying roller pair; and a sensor configured to detect an end of the sheet and is disposed downstream of the second conveying roller pair but not between second conveying roller pair and third conveying roller pair, wherein the sheet is guided along the guiding member when a bending part of the sheet is conveyed to the third conveying roller pair by rotating the second conveying roller pair in a reverse direction while the sheet is held by the first conveying roller pair and the second conveying roller pair, and wherein the guiding member is stationary and has a concave shape.

* * * * *